United States Patent [19]

Suga

[11] 4,075,528

[45] * Feb. 21, 1978

[54] XENON LAMP WITH MAGNETS ON THE ELECTRODES

[76] Inventor: Shigeru Suga, Yoyogi 5-20-2, Shibuya, Tokyo, Japan

[ * ] Notice: The portion of the term of this patent subsequent to Nov. 9, 1993, has been disclaimed.

[21] Appl. No.: 777,938

[22] Filed: Mar. 15, 1977

[51] Int. Cl.[2] ..... H01J 1/50; H01J 61/16

[52] U.S. Cl. ..... 313/154; 313/161; 313/224

[58] Field of Search ..... 313/153, 161, 224, 154

[56] References Cited

U.S. PATENT DOCUMENTS

| | | | |
|---|---|---|---|
| Re. 27,443 | 7/1972 | Kyp | 313/153 X |
| 2,410,054 | 10/1946 | Fremlin et al. | 313/155 X |
| 3,881,132 | 5/1975 | Miller | 313/161 X |
| 3,991,336 | 11/1976 | Suga | 313/161 X |

*Primary Examiner*—Palmer C. Demeo

*Attorney, Agent, or Firm*—Wenderoth, Lind & Ponack

[57] ABSTRACT

A xenon lamp containing open ring-shaped magnets mounted inside the tube of the lamp between the discharge portion of an electrode and the portion of the electrode sealed in the end of said tube, whereby the metallic vapor and other volatilized matters due to the elevated temperature of the electrode at the time of discharge are adhered on the magnet due to the magnetic field thereof and do not adhere to the inside of the tube to thereby prevent blackening, devitrification and white-turbidity of the tube.

2 Claims, 6 Drawing Figures

XENON LAMP WITH MAGNETS ON THE ELECTRODES

The present invention relates to a xenon lamp, and more particularly to a xenon lamp having magnets for preventing blackening and like effects in the tube of the lamp.

BACKGROUND OF THE INVENTION AND PRIOR ART

As illustrated in FIG. 1, conventional xenon lamps generally have a construction in which electrodes 1 and 1' such as thoriated tungsten electrodes are sealed in the ends of a quartz glass tube 2, the inside of which is charged with xenon gas, and the electrodes are connected to an electric circuit for causing a discharge through the xenon for causing the emission of light. Upon discharge, the electrodes are heated and the temperature of the tip ends, thereof becomes high, causing a small quantity of the metal of the electrodes to evaporate and then condense on and adhere throughout the inside of the tube 2. This deposit blackens the tube. The blackened tube absorbs light and the quantity of transmitted light decreases. For example, it has been found that after a lighting period of 100 hours, the quantity of light emitted from the tube decreases by about 10% to 30%. Consequently, if a xenon lamp having such a construction is used as a light source in a light fastness tester which required a stable or constant quantity of light, correct test resuls cannot be obtained.

As means for preventing this blackening, there has been proposed an arrangement in which a ring magnet is provided around the outside of the tube of the xenon lamp near the electrodes, as in U.S. Pat. No. 3,991,336 entitled "Magnetized xenon lamp". This arrangement is indeed effective to prevent the occurrence of blackening in the portion of the tube from which most of the light is emitted, but it is disadvantageous in that the tube wall near the ring-shaped magnet blackens to an extreme degree and eventually becomes whitely turbid and devitrified, thus becoming liable to undergo fissure and breakage.

OBJECT AND BRIEF SUMMARY OF THE INVENTION

It is the object of the present invention to provide magnet arrangement which overcomes this problem.

According to the present invention, a magnet is mounted around the electrode of a xenon lamp within the tube and between the tip of the electrode sealed into the end of the tube of the xenon lamp. Metallic vapor and other volitilized matter are attached to and adhered to the magnet, and only the magnet blackens, so that blackening, devitrification and white-turbidity of the inside of the tube is prevented and a constant quantity of light without reduction in the quantity of light is insured even after lighting over a long period and no damage to the tube is caused.

BRIEF DESCRIPTION OF THE DRAWINGS

The invention will now be explained with reference to the accompanying drawings, in which.

DETAILED DESCRIPTION OF THE INVENTION

Figure 1:
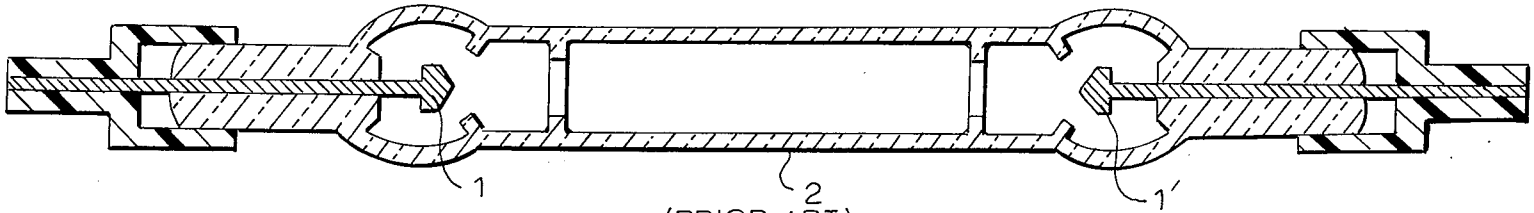
(PRIOR ART) FIG.1
FIG. 1 is a longitudinal section showing the structure of a conventional xenon lamp.
Figure 2:
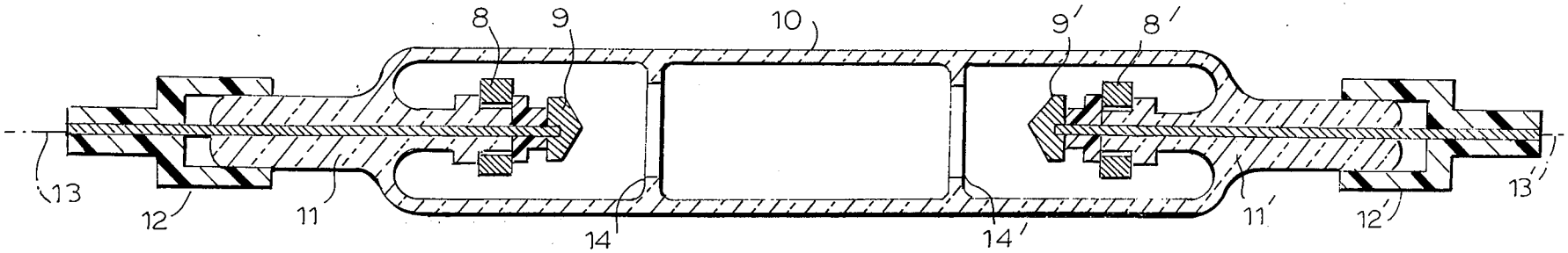
FIG. 2 is a longitudinal section showing the structure of a xenon lamp containing magnets according to the present invention.

As shown in FIG. 2, the xenon lamp has electrodes 9 and 9' in opposite ends of a quartz tube 10 at electrode sealing portions 11 and 11'. Tube holders 12 and 12' hold the sealing portions and the electrodes are connected to an electric circuit by conductors 13 and 13' which extend through the holders 12 and 12'. Ring-shaped projections 14 and 14' are provided around the inside of the tube.

Figure 3:
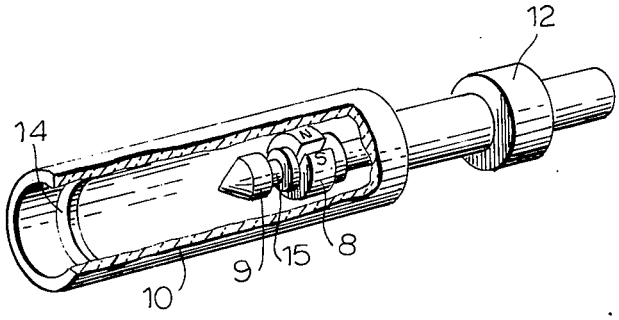
FIG. 3 is a partial cutaway view of the lamp of FIG. 2 showing the external appearance of the electrode portion.
Figure 4:
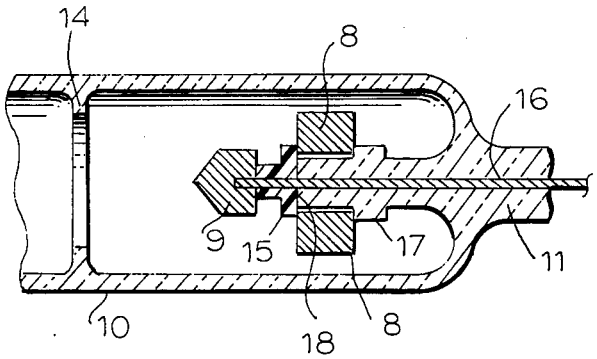
FIG. 4 is a sectional view, on an enlarged scale, of the electrode portion shown in FIG. 3.
Figure 5:
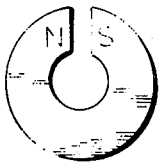
FIG. 5 is an end view of the magnet.
Figure 6:
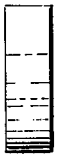
FIG. 6 is a side elevation view of the magnet.

Magnets 8 and 8', each in the form of an open ring, i.e. ring having a gap therein, as shown in FIGS. 5 and 6, and having N and S poles on opposite sides of the gap, are mounted within the tube 10 around each electrode. The mounting of the magnets is shown in detail in FIGS. 3 and 4.

Sealed the sealing portion 11 is a linear or ribbonlike electrode bar 16 extending from the end of the tube 10 into the interior of the tube. The sealing portion 11 extends into the tube 10 to a point 18, and has a large-diameter portion 17 thereon. The magnet is mounted on the inner end of the sealing portion 11 until one side of the magnet contacts the large-diameter portion 17. Then a bushing 15 of a heat-resisting, electric insulating material (e.g. ceramic or quartz glass) is placed over the electrode bar 16 until it contacts the other side of the magnet to hold the magnet 8 on the sealing portion 11. Then the electrode 9 is fixed on the end of the electrode bar 16.

Upon discharge of the lamp, an electric current flows and the temperature of the electrode rises, causing evaporation of a small quantity of material from the electrodes. The metal thus evaporated from the electrodes and ionized is acted on by the magnetic force due to the magnetic field on the magnet and so cannot move freely. It is attracted to and adheres to the magnet 8. It does not adhere to the portion of the inside of the tube from which light to be utilized is emitted, and so the said portion does not become black. Moreover, the tube portion around the electrodes undergoes neither devitrification nor white-turbidity. Consequently, it is possible to obtain a constant quantity of light over a long period. As a result of a test, it has been found that after a lighting period of 1,500 hours the decrease in the quantity of light due to blackening, etc. is less than 10% and that as compared with a conventional xenon lamp, that is a 10% to 30% reduction after lighting for 100 hours and about 40% reduction after 1,000 hours, the present device is extremely effective.

What is claimed is:

1. A xenon lamp comprising a transparent tube, and electrode structure at each end of said tube including an electrode extending into said tube and sealing said electrode into the end of said tube, and an open ring magnet around each electrode structure and mounted on the electrode structure between the free end of the electrode within the tube and the end of the tube in which the electrode is sealed.

2. A xenon lamp as claimed in claim 1 in which said electrode construction comprises a portion of said tube extending into said end of said tube, a conductor extending from outside said tube through said portion into the interior of said tube, an electrode on the free end of said conductor, said portion of said tube having a part with the same diameter as the interior of said open ring magnet and on which said open ring magnet is mounted, said portion of said tube having a larger diameter part between said same diameter part and the end of the tube against which one end face of said open ring magnet abuts and a bushing of insulating material around said conductor between said electrode and said portion of said tube and engaging the other end face of said open ring magnet for holding said open ring magnet on said portion of said tube.

* * * * *